US008256049B1

(12) United States Patent
Sinks

(10) Patent No.: US 8,256,049 B1
(45) Date of Patent: Sep. 4, 2012

(54) COMPACT SLEEP ENHANCEMENT KIT

(76) Inventor: Michael D. Sinks, Chester, VA (US)

( * ) Notice: Subject to any disclaimer, the term of this patent is extended or adjusted under 35 U.S.C. 154(b) by 0 days.

(21) Appl. No.: 12/930,297

(22) Filed: Jan. 4, 2011

(51) Int. Cl.
*A47G 9/00* (2006.01)

(52) U.S. Cl. ..... 5/632; 5/638; 5/646

(58) Field of Classification Search ..... 5/630, 632, 5/636, 638, 646, 652, 652.1; 2/17, 91, 203, 2/208
See application file for complete search history.

(56) References Cited

U.S. PATENT DOCUMENTS 869,741 A * 10/1907 Seitzman ..... 2/206
1,916,507 A * 7/1933 Green et al. ..... 2/91
2,667,869 A * 2/1954 D Elia ..... 128/857
2,870,448 A * 1/1959 Rosenthal ..... 2/91
4,488,315 A * 12/1984 Hoerlein ..... 2/91
5,269,323 A * 12/1993 Krouskop ..... 5/632
5,385,322 A * 1/1995 Kim et al. ..... 248/118
5,544,377 A * 8/1996 Gostine ..... 5/630
5,584,302 A * 12/1996 Sillaway et al. ..... 5/630
6,182,311 B1 * 2/2001 Buchanan et al. ..... 5/632
7,322,061 B2 * 1/2008 Carroll ..... 5/630
7,587,773 B2 * 9/2009 Littlehorn et al. ..... 5/655
2009/0133192 A1 * 5/2009 Hassell et al. ..... 5/639

* cited by examiner

*Primary Examiner* — William Kelleher
(74) *Attorney, Agent, or Firm* — Norman B. Rainer

(57) ABSTRACT

A kit of interactive soft-bodied components for sleep enhancement of a seated person includes a sling member having finger-accommodating pockets which enable the sling member to embrace the user's cheeks and chin when the user's forearms are upwardly raised from bent elbows, and an elbow accommodating member having an elongated central region with extremities having cushioned elbow receiving pads.

3 Claims, 3 Drawing Sheets

COMPACT SLEEP ENHANCEMENT KIT

BACKGROUND OF THE INVENTION

1. Field of the Invention

The present invention generally relates to devices for supporting the head of a person to induce sleeping, and in its preferred embodiments more specifically relates to a kit of components for adjustably supporting the head of a person seated in an upright position to facilitate resting or sleeping.

2. Description of the Prior Art

Many people have difficulty sitting comfortably in an unsupported upright position for long periods of time, and many people have difficulty resting or sleeping in an upright position during, e.g., long trips in airplanes and other public or private conveyances. The space allocated for each person in such vehicles is limited and a seated passenger is constrained to a limited range of positions. Although seats may be reasonably comfortable for short periods of time, over longer periods of time they can become very uncomfortable and passengers often arrive at their destinations very stiff, sore, and tired. Various approaches have been used in an effort to address this problem and provide an increased level of comfort, but devices known in the prior art have not proven to be fully effective in addressing the need.

Certain prior approaches, such as disclosed in U.S. Pat. Nos. 7,758,125; 6,805,403; 6,007,156; 5,505,523 and 4,707,031 involve a head-supporting mechanism that attaches to or otherwise interacts with the upright rear back support portion of the seat structure. Such interaction is not dependably achievable because of variations in the size, shape, angle and spacing of back supports. Also, such interactions generally require structural components which occupy considerable space in the passenger's limited luggage capacity. Furthermore, considerable effort is usually required for deployment of the mechanism from its storage state to its properly adjusted active state.

Other prior approaches, such as disclosed in U.S. Pat. Nos. 7,055,908; 6,231,535; 4,565,408; 4,183,583 and 4,161,946 employ rigid bracing elements which counteractively transfer to the passenger's neck region the force applied to support his head. Such embodiments not only cause lingering pain to the neck region, but require considerable storage space in the passenger's luggage.

In office environments, workers often spend six to eight hours a day sitting at a desk. It has been found that a rest period is beneficial for the worker's comfort, health, productivity and general demeanor. Whereas it may be inefficient for the worker to leave the office environment to indulge in a brief period of relaxation, the possibility of achieving rest or relaxation while at the desk is appealing. Any means for facilitating such relaxation would have to be of reasonably inconspicuous nature and easily stored and deployed. Earlier disclosed sleep or rest enhancing devices intended for seated passengers are not applicable to a desk-bound office worker.

It is accordingly an object of the present invention to provide means for supporting the head of a seated person in a manner to produce a restful state or enhance sleep.

It is a further object of this invention to provide head supporting means of the foregoing object which do not include rigid components that would occupy considerable storage space when not in use.

It is another object of the present invention to provide head supporting means of the aforesaid nature which do not require interaction with a back supporting portion of a seat structure.

It is a still further object of this invention to provide compact, easily stored and deployed means for supporting the head of a seated person.

These objects and other objects and advantages of the invention will be apparent from the following description.

SUMMARY OF THE INVENTION

The above and other beneficial objects and advantages are accomplished in accordance with the present invention by a kit of interactive soft-bodied components for sleep enhancement of a seated person comprising:

a) a sling member comprised of an elongated band of compliant but substantially non-extensible construction extending between opposed extremities and bounded in part by a flat upper surface and a lower surface having a finger-accommodating pocket associated with each extremity, thereby enabling said upper surface to embrace the person's cheeks and chin, and b) an elbow accommodating member comprised of an elongated central region of adjustable length terminating in opposed anchoring extremities bounded by upper and lower surfaces, said lower surface having non-slip gripping properties, and said upper surface having cushioned elbow receiving means.

An optional additional component of said kit is an eye cover adapted to be secured to both finger-accommodating pockets by releasable bridging attachment thereto, causing the cover to be controllably pushed against the user's closed eyes.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
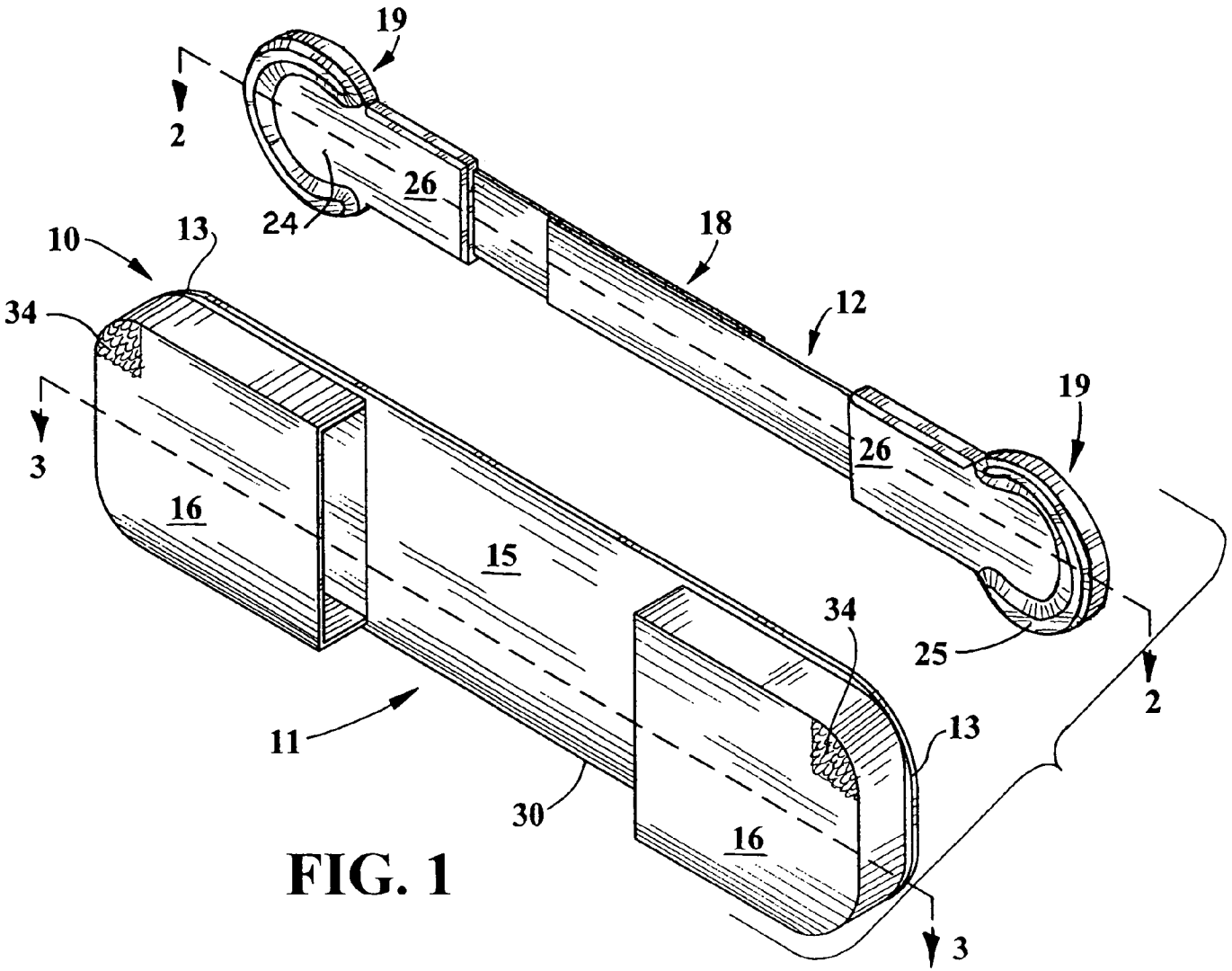
FIG. 1 is a perspective view of an embodiment of the sleep-enhancing kit of the present invention.
Figure 2:
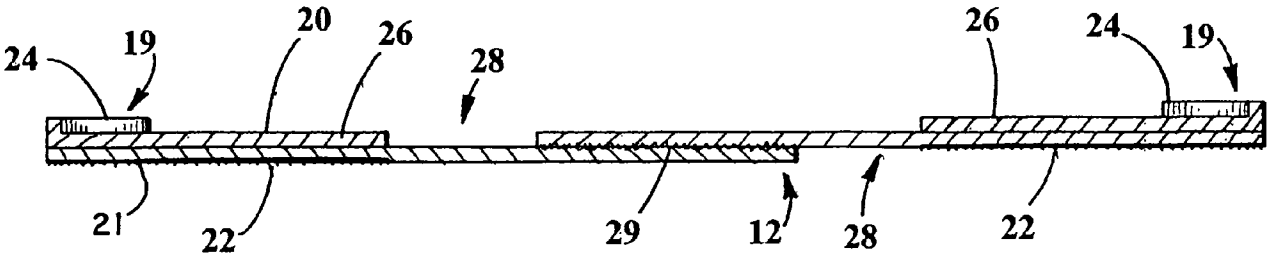
FIG. 2 is a sectional view taken in the direction of the arrows upon the line 2-2 of FIG. 1.
Figure 3:
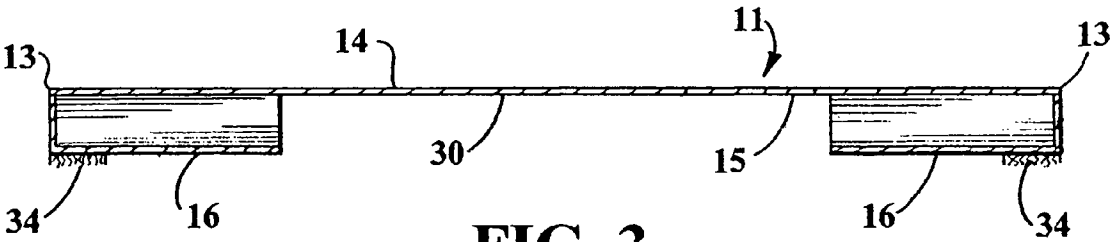
FIG. 3 is a sectional view taken in the direction of the arrows upon the line 3-3 of FIG. 1.

Referring now to FIGS. 1-5, an embodiment of the sleep enhancing kit 10 of the present invention is shown comprised of sling member 11, elbow accommodating member 12 and optional eye cover 13.

Sling member 11 is comprised of an elongated band 30 of compliant but substantially non-extensible construction. Suitable materials of construction include woven and non-woven fabrics, and plastics in film and net forms. Said sling member extends between opposed extremities 13, and is bounded in part by a flat upper surface 14 and lower surface 15 having finger-accommodating pockets 16 associated with each extremity 13.

Pockets 16 may either be attached to lower surface 15 or may be continuous integral extensions thereof, particularly when band 30 is a fabric. The dimensions of said pockets should be such as to receive four fingers of the user's hands in either extended state or bent at the second joints.

Figure 5:
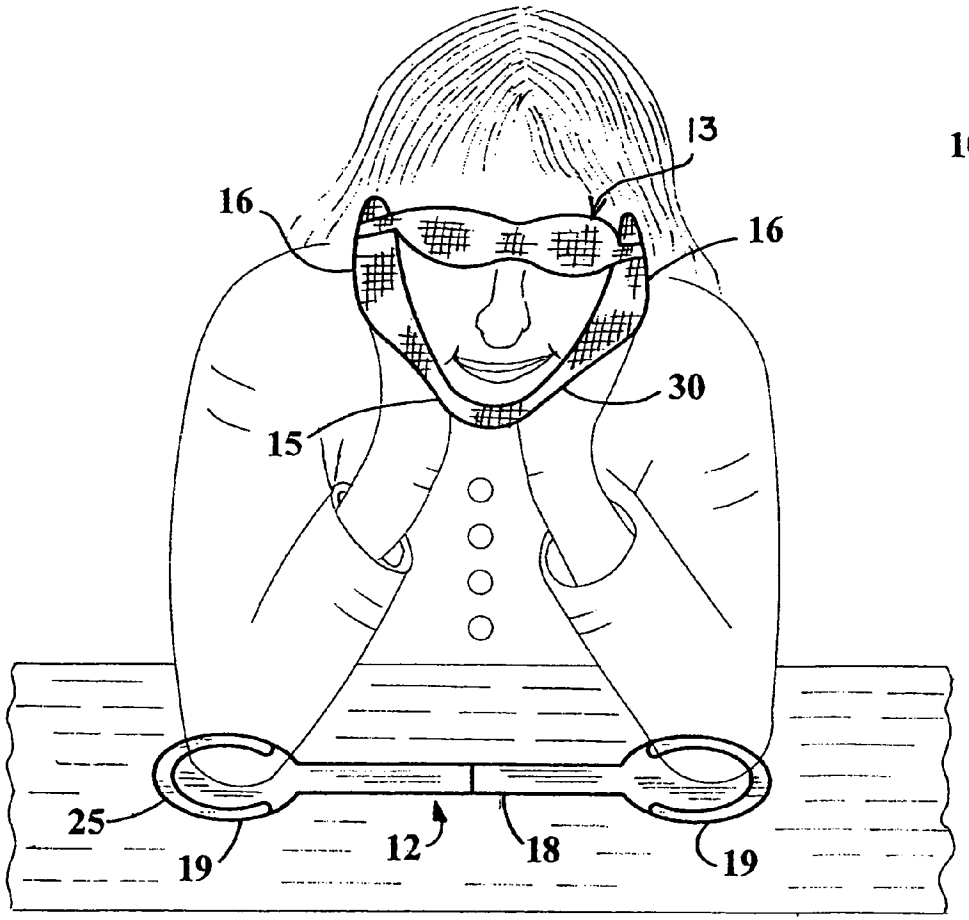
FIG. 5 is a front view showing the use of the kit by a seated person whose elbows are resting upon a desk surface.

In use, as shown in FIG. 5, the user's hands engage said pockets and are brought into contact with the upper cheek regions of the user's face. This is done by causing the forearms to be upwardly directed from bent elbows. Such emplacement causes upper surface 14 to embrace the chin region in the manner of a sling. In such manner of use, the user's elbows are caused to rest upon a support surface such as a table, desk, or paired arm rests, and are spaced at about shoulder width. With narrow elbow spacing, the most comfortable manner of use is to insert four extended fingers of each hand into the pockets. With wide elbow spacing, such as when paired arm rests are employed to support the elbows, the inserted fingers are best bent at the second joints.

Elbow accommodating member 12 is shown comprised of elongated central region 18 terminating in opposed anchoring extremities 19. Said extremities are bounded in part by upper and lower surfaces 20 and 21, respectively. A non-slip gripping region 22 is associated with lower surfaces 21. Said non-slipping property may be provided by a rubbery layer adapted to interact frictionally with a flat supporting surface. Cushioned elbow receiving means 24 are positioned above said gripping regions. The elbow receiving means may have a U-shaped configuration by virtue of an upraised embracing lip 25, and have a cushioning layer 26 fabricated of foam rubber or equivalent resilient materials.

The exemplified elbow accommodating member 12 is shown comprised of two separate pieces 28 which are adjustably joined by way of interactive hook and loop fiber attachment substrates 29, commercially available as VELCRO. Such manner of length adjustment permits variation in the lateral separation of elbow receiving means 24. However, other means of length adjustment are contemplated such as a belt buckle, button and eyelet combination, and interactive magnetic strips.

Figure 4:
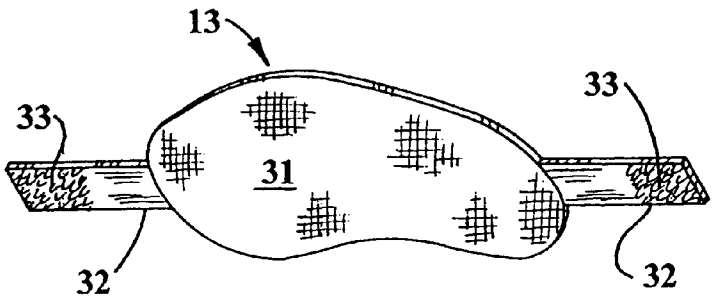
FIG. 4 is a perspective rear view of an embodiment of an eye cover which may optionally be included in the kit of the present invention.

An eye cover member 13 shown in FIG. 4 is comprised of compliant panel 31 and opposed attachment straps 32 having VELCRO substrates 33 adapted to releasibly attach to interactive VELCRO substrates 34 on pockets 16. By virtue of such construction, the eye cover member can optionally be employed, as shown in FIG. 5 whereby the compliant panel is pressed against the user's closed eyes. Such manner of use avoids the conventional use of an elastic head strap for wearing eye covers, and the attendant entanglement with or shuffling of the user's hair.

Figure 6:
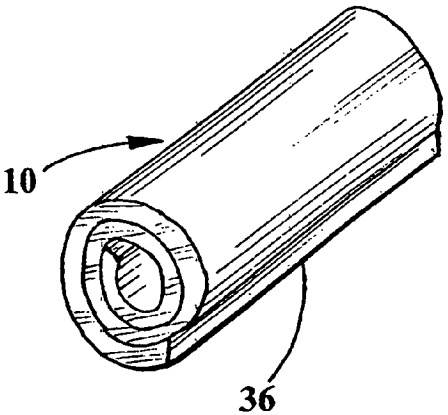
FIG. 6 is a perspective view of a marketing package containing the kit of this invention.

The components of the kit of this invention may be compacted by way of folding or rolling together so as to form a storage package 36 such as shown in FIG. 6 which occupies less than 500 cubic centimeters of space in a desk drawer or in a traveller's pocket book or carry-on luggage. From a marketing standpoint, the kit could be sold as a packaged traveller's sleep enhancing system, which might also include earplugs of conventional design.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A kit of interactive soft-bodied components for sleep enhancement of a seated person comprising:

a) a sling member comprised of an elongated band of compliant but substantially non-extensible construction extending between opposed extremities and bounded in part by a flat upper surface and a lower surface having a finger-accommodating pocket associated with each extremity, whereby when said extremities are upwardly directed, the person's fingers can enter said pockets, causing said upper surface to embrace the person's cheeks and upwardly support the chin, and b) an elbow accommodating member comprised of an elongated central region of adjustable length terminating in opposed anchoring extremities bounded by upper and lower surfaces, said lower surfaces having non-slip gripping properties, and said upper surfaces having cushioned elbow receiving means and an upraised U-shaped embracing lip, c) said sling member and elbow accommodating member being confinable without compression into a package which occupies less than 500 cubic centimeters of space.

2. The kit of claim 1 wherein said elongated band is of fabric construction, and said pockets are continuous integral extensions thereof.

3. The kit of claim 1 wherein said central region of adjustable length involves two separate pieces which are interactively engaged by hook and loop fiber attachment substrates.

* * * * *